US008584634B2

(12) United States Patent
Wigsten

(10) Patent No.: US 8,584,634 B2
(45) Date of Patent: Nov. 19, 2013

(54) PHASER BUILT INTO A CAMSHAFT OR CONCENTRIC CAMSHAFTS

(75) Inventor: Mark M. Wigsten, Lansing, NY (US)

(73) Assignee: BorgWarner Inc., Auburn Hills, MI (US)

( * ) Notice: Subject to any disclaimer, the term of this patent is extended or adjusted under 35 U.S.C. 154(b) by 334 days.

(21) Appl. No.: 13/061,997

(22) PCT Filed: Sep. 10, 2009

(86) PCT No.: PCT/US2009/056429

§ 371 (c)(1), (2), (4) Date: Mar. 3, 2011

(87) PCT Pub. No.: WO2010/033415

PCT Pub. Date: Mar. 25, 2010

(65) Prior Publication Data

US 2011/0162604 A1 Jul. 7, 2011

Related U.S. Application Data

(60) Provisional application No. 61/098,274, filed on Sep. 19, 2008, provisional application No. 61/098,289, filed on Sep. 19, 2008.

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | |
|---|---|---|---|
| 1,953,547 | A | 4/1934 | Wolff |
| 5,107,804 | A | 4/1992 | Becker et al. |
| 5,165,303 | A | 11/1992 | Riemscheid et al. |
| 5,235,939 | A | 8/1993 | Levin et al. |
| 5,402,759 | A | 4/1995 | Ding et al. |
| 5,497,738 | A | 3/1996 | Siemon et al. |
| 5,577,420 | A | 11/1996 | Riemscheid et al. |
| 5,664,463 | A | 9/1997 | Amborn et al. |
| 5,666,914 | A | 9/1997 | Ushida et al. |

(Continued)

FOREIGN PATENT DOCUMENTS

| | | |
|---|---|---|
| DE | 3934848 | 4/1991 |
| DE | 19903622 A1 | 8/1999 |

(Continued)

OTHER PUBLICATIONS

Supplementary European Search Report for EO09815005.5; mailed Jun. 21, 2012; 6 pages.

(Continued)

*Primary Examiner* — Ching Chang
(74) *Attorney, Agent, or Firm* — Brown & Michaels, PC

(57) ABSTRACT

A camshaft assembly for an internal combustion engine comprising: a hollow outer shaft 2, an inner shaft 4, cam lobes 6, 8, a phaser 42, 32, and a remote control valve 16. The inner shaft 4 is received within the hollow outer shaft 2. The phaser 42, 32 is mounted to the inner and outer shafts 4, 2. The remote control valve 16 controls the flow of fluid to and from the phaser 42, 32 through a plurality of passages 22, 24, 26, 28 and the inner shaft 4.

9 Claims, 8 Drawing Sheets

(56) References Cited

U.S. PATENT DOCUMENTS

| | | | | |
|---|---|---|---|---|
| 6,035,818 | A | 3/2000 | Sato et al. | |
| 6,725,817 | B2 | 4/2004 | Methley et al. | |
| 6,763,791 | B2 | 7/2004 | Gardner et al. | |
| 6,772,721 | B1 | 8/2004 | Gardner et al. | |
| 6,832,586 | B2 | 12/2004 | Williams | |
| 6,854,435 | B2 | 2/2005 | Williams | |
| 6,883,481 | B2 | 4/2005 | Gardner et al. | |
| 6,899,126 | B2 | 5/2005 | Weigand et al. | |
| 7,159,549 | B2 | 1/2007 | Tsukada et al. | |
| 7,228,831 | B1 | 6/2007 | O'Gorman et al. | |
| 7,287,499 | B2 * | 10/2007 | Lawrence et al. | 123/90.17 |
| 2003/0196618 | A1 | 10/2003 | Simpson | |
| 2004/0055550 | A1 | 3/2004 | Smith | |
| 2005/0028771 | A1 | 2/2005 | Jiang | |
| 2005/0279302 | A1 | 12/2005 | Lancefield et al. | |
| 2006/0185471 | A1 | 8/2006 | Lawrence et al. | |
| 2006/0207529 | A1 | 9/2006 | Lawrence et al. | |
| 2006/0207538 | A1 | 9/2006 | Lancefield et al. | |
| 2007/0272183 | A1 | 11/2007 | Schneider | |
| 2007/0295296 | A1 | 12/2007 | Lettmann et al. | |
| 2008/0135004 | A1 | 6/2008 | Simpson et al. | |

FOREIGN PATENT DOCUMENTS

| | | | |
|---|---|---|---|
| EP | 0254058 | | 1/1988 |
| EP | 1614867 | | 1/2006 |
| GB | 2327482 | | 1/1999 |
| GB | 2431977 | A | 5/2007 |
| GB | 2432645 | A | 5/2007 |
| JP | 07286507 | | 10/1995 |
| JP | 11210433 | | 3/1999 |
| WO | 2006000832 | | 1/2006 |
| WO | 2006050686 | | 5/2006 |
| WO | 2006067519 | | 6/2006 |
| WO | 2006081788 | | 8/2006 |
| WO | 2006097767 | | 9/2006 |
| WO | 2008028902 | A1 | 3/2008 |
| WO | 2008042621 | | 4/2008 |

OTHER PUBLICATIONS

International Search Report and Written Opinion for PCT/US2009/056429, mailed Apr. 26, 2010; 10 pages.

* cited by examiner

PHASER BUILT INTO A CAMSHAFT OR CONCENTRIC CAMSHAFTS

REFERENCE TO RELATED APPLICATIONS

This application claims one or more inventions which were disclosed in Provisional Application No. 61/098,274, filed Sep. 19, 2008, entitled, "PHASER BUILD INTO A CAMSHAFT OR CONCENTRIC CAMSHAFTS" and in Provisional Application No. 61/098,289, filed Sep. 19, 2008, entitled, "CAM TORQUE ACTUATED PHASER USING BAND CHECK VALVES BUILD INTO A CAMSHAFT OR CONCENTRIC CAMSHAFTS." The benefit under 35 USC §119(e) of the United States provisional application is hereby claimed, and the aforementioned applications are hereby incorporated herein by reference.

BACKGROUND OF THE INVENTION

1. Field of the Invention

The invention pertains to the field of phasers built into a camshaft or concentric camshafts. More particularly, the invention pertains to a torsion assist phaser using band check valves built into a camshaft or concentric camshafts or an oil pressure actuated phaser built into a camshaft or concentric camshafts.

2. Description of Related Art

Cam in cam systems are well know in the prior art. In prior art cam in cam systems, the camshaft has two shafts, one positioned inside of the other. The shafts are supported one inside of the other and are rotatable relative to one another.

SUMMARY OF THE INVENTION

A camshaft assembly for an internal combustion engine comprising: a hollow outer shaft, an inner shaft, cam lobes, a phaser, and a remote control valve. The inner shaft is received within the hollow outer shaft. The phaser is mounted to the inner and outer shafts. The remote control valve controls the flow of fluid to and from the phaser through a plurality of passages and the inner shaft.

The phaser may be torsion assist or oil pressure actuated.

DETAILED DESCRIPTION OF THE INVENTION

Figure 1:
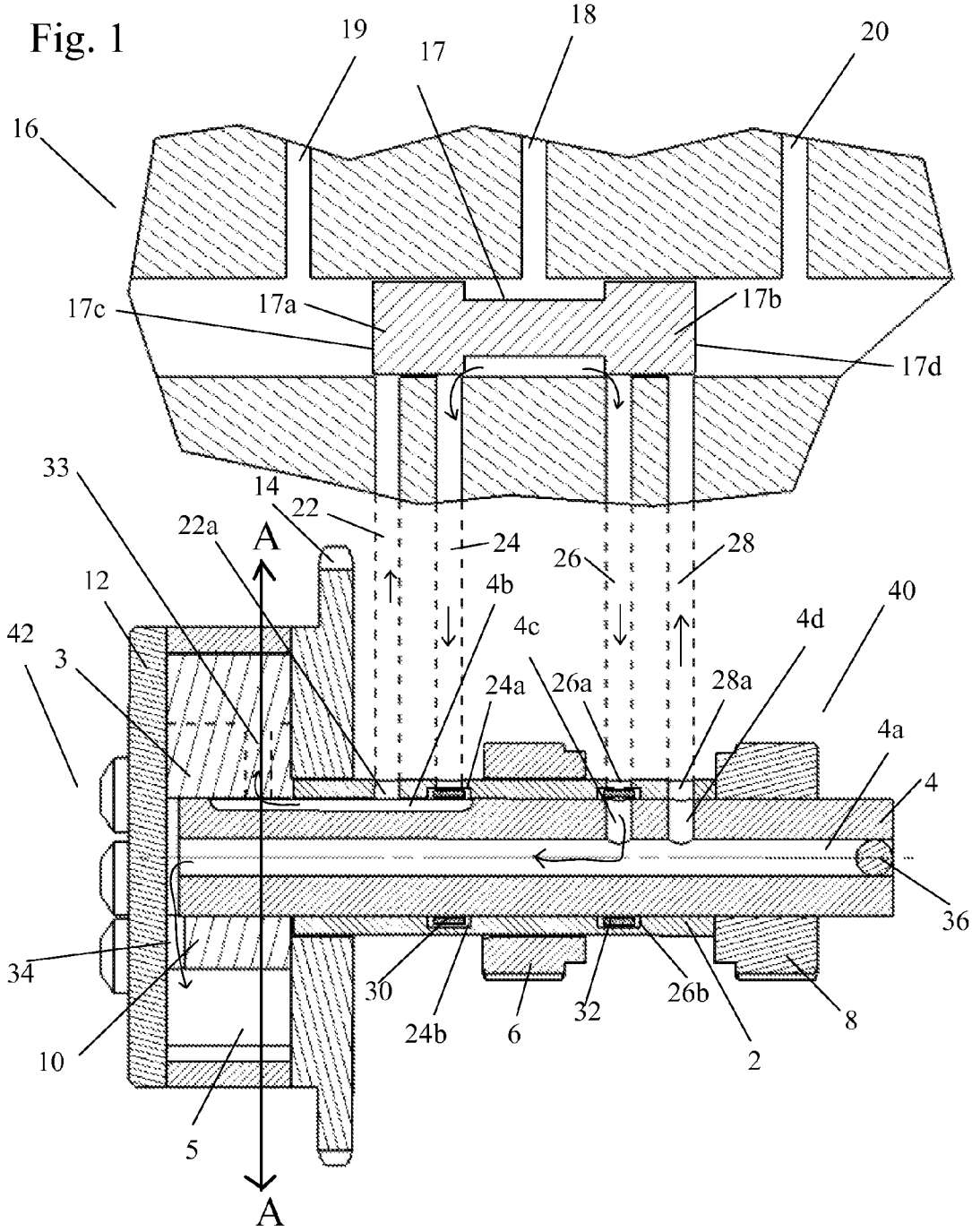
FIG. 1 shows a schematic of a camshaft assembly of a first embodiment in the null position.

FIGS. 1-3 and 5 show a camshaft assembly attached to a phaser 42 of a first embodiment of the present invention.

The camshaft assembly 40 has an inner shaft 4 and an outer shaft 2. The camshaft assembly 40 may be for a multiple cylinder engine or a single cylinder engine.

For a multiple cylinder engine, the outer shaft 2 is hollow with multiple slots (not shown) that run perpendicular to the axis of rotation and has a sprocket 14 attached to the outside of the outer shaft 2. Inside the hollow outer shaft 2 is a hollow inner shaft 4 with multiple holes (not shown) that run perpendicular to the length of the shaft. A first set of cam lobes 6 are rigidly attached to the outer shaft 2 and a second set of cam lobes 8 are free to rotate and placed on the outer shaft 2 with a clearance fit. The second set of cam lobes 8 are positioned over slots (not shown) on the outer shaft 2 and are controlled by the inner shaft 4 through a mechanical connection (not shown).

For single cylinder engines, the outer shaft 2 is hollow and has a sprocket 14 attached to the outside of the outer shaft 2. Inside the hollow outer shaft 2 is a hollow inner shaft 4. At least one cam lobe 6 is directly attached or hard pressed to the outer shaft 2 and at least one other cam lobe 8 is directly attached or hard pressed to the inner shaft 4.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers 42 have a rotor 10 with one or more vanes 10*a*, mounted to the end of the camshaft assembly 40, surrounded by or coaxially located within the housing 12. The housing 12 and the rotor 10 form chambers in which the vanes 10*a* fit, dividing the chambers into advance chambers 3 and retard chambers 5. The vane 10*a* is capable of rotation to shift the relative angular position of the housing 12 and the rotor 10. It is possible to have the vanes mounted to the housing 12, and the chambers in the rotor 10, as well. A portion of the housing's outer circumference forms the sprocket 14, pulley or gear accepting drive force through a chain, belt, or gears, usually from the crankshaft, or possible from another camshaft in a multiple-cam engine and is mounted to the outer shaft 2. The inner shaft 4 is mounted to the rotor 10.

The phaser 42 adjusts the phase of the shafts 2, 4 relative to each other. A remote control valve 16 controls the flow of fluid into the camshaft assembly 40 and to the phaser 42. The remote valve 16 includes a spool 17 with at least two circumferential lands 17*a*, 17*b* biased in a first direction and a second, opposite direction. While not shown, the spool 17 may be biased by fluid, springs, or actuator or combination of fluid, springs, and actuator in first and second directions.

Passages 22, 24, 26, 28 between the remote control valve 16 and the camshaft assembly 40 allow fluid to be supplied to and vented from the chambers 3, 5 of the phaser. The passages 22, 24, 26, 28 between the remote control valve 16 and the camshaft assembly 40 lead to ports 22*a*, 24*a*, 26*a*, 28*a* and annuluses 24*b*, 26*b* in the outer shaft 2 that open to holes 4*a*, 4*c*, 4*d* and/or grooves 4*b* in and on the inner shaft 4. From the inner shaft 4, the fluid flows to or from the advance passage 33 or the retard passage 34 and to the advance and retard chambers 3,5. Any combination of holes or grooves may be used to supply and vent fluid from the advance and retard chambers 3, 5 through the advance passage 33 or the retard passage 34 to the inner shaft 4.

In one example, a groove 4*b* on the outer surface of the inner shaft 4 provides fluid to and from the advance chamber 3 through the advance passage 33 and holes 4*a*, 4*c*, 4*d* within the inner shaft 4 provides fluid to and from the retard chamber through the retard passage 34 as shown in FIGS. 1-3 and 5. A plug 36 is present at the end of the inner shaft 4 to close off the hole 4*a* in the inner shaft 4.

Alternatively, the groove 4*b* on the outer surface of the inner shaft 4 could provide fluid to and from the retard chamber 5 and the holes 4*a*, 4*c*, 4*d* within the inner shaft 4 could provide fluid to and from the advance chamber 3.

Additionally, two grooves (not shown) on the outer surface of the inner shaft 4 may be used to provide fluid to and from the advance and retard chambers 3, 5 or two drilled holes within the inner shaft 4 may be used to provide fluid to and from the advance and retard chambers 3, 5.

Check valves 30, 32 are present in the annuluses 24*b*, 26*b* of the outer shaft 2 in the inlet passages 24, 26 to the advance and retard chambers 3, 5. The check valves 30, 32 are preferably band check valves or disc check valves, although other types of check valves may also be used. In this embodiment, the phaser 42 is torsion assist. Examples of a torsion assist phaser that may be used are found in U.S. Pat. No. 6,883,481 entitled, "Torsional Assisted Multi-Position Cam Indexer Having Controls Located In Rotor", U.S. Pat. No. 6,772,721, entitled "Torsional Assist Cam Phaser For Cam In Block Engines", and U.S. Pat. No. 6,763,791, entitled "Cam Phaser For Engines Having Two Check Valves In Rotor Between Chambers And Spool Valve" and are hereby incorporated by reference.

FIG. 1 shows the phaser 42 in a null position. In this position, the force on one end 17*c* of the spool 17 is equal to the force on the second end 17*d* of the spool 17 and the first land 17*a* blocks flow from the advance vent passage 22 venting the advance chamber 3 and the second land 17*b* blocks flow from the retard vent passage 28 venting the retard chamber 5. Fluid is supplied to the advance and retard chambers 3, 5 through passages 24, 26 respectively. In order to provide fluid from the pressurized source (not shown) through the inlet line 18 to the advance and retard chambers 3, 5, the spool 17 may be dithered or a portion of the first and second lands 17*a*, 17*b* may be shaped to allow a small amount of fluid into the advance inlet and retard inlet passages 24, 26.

Figure 2:
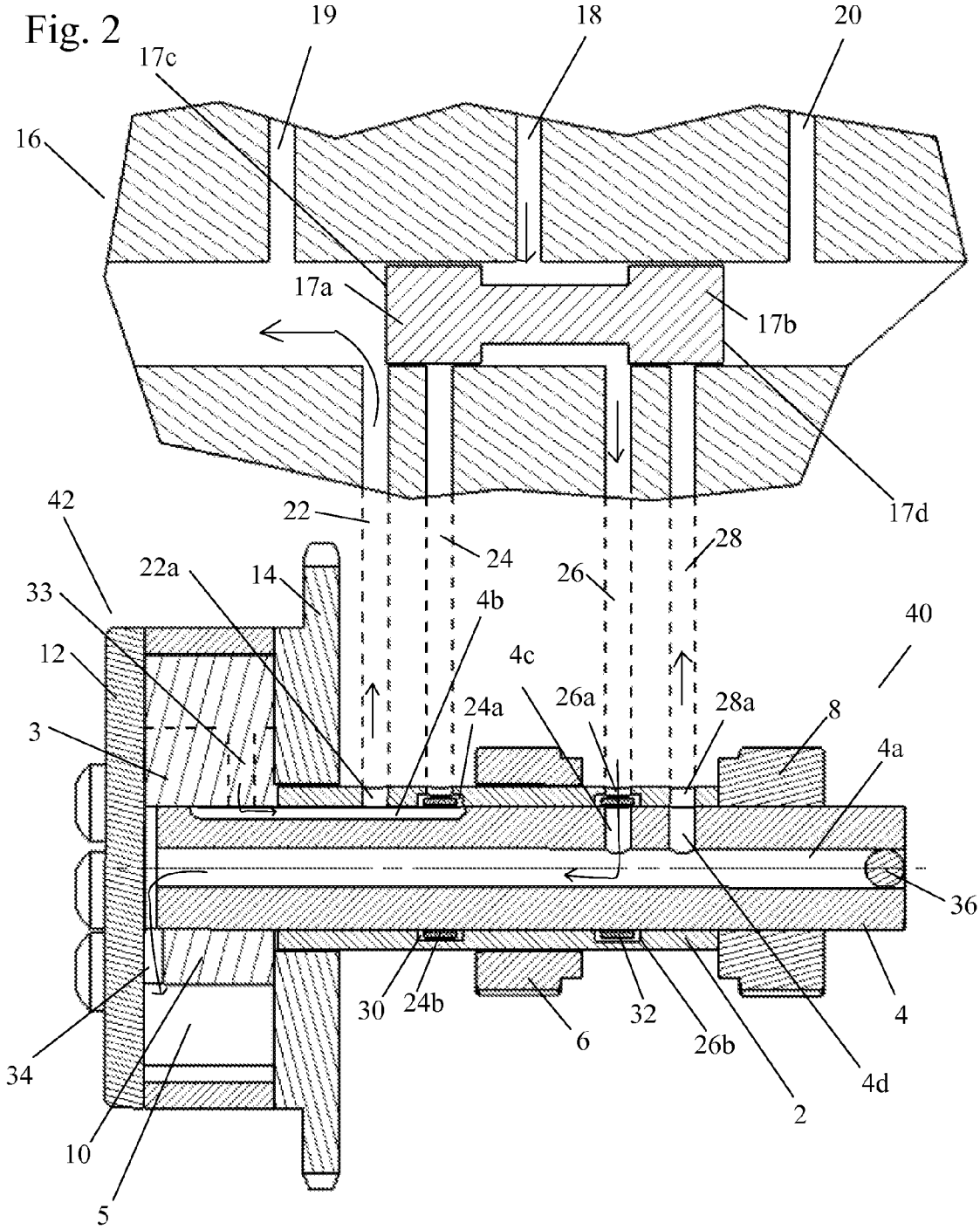
FIG. 2 shows a schematic of a camshaft assembly of a first embodiment moving towards the retard position.

FIG. 2 shows the phaser moving towards the retard position. In this position, the force on the first side 17*c* of the spool 17 is greater than the force on the second side 17*d* of the spool 17, moving the spool 17 towards a position where the first land 17*a* blocks the advance inlet passage 24 and the second spool land 17*b* blocks the retard vent passage 28, allowing the advance vent passage 22 to be open and vent any fluid to sump 19 and the retard inlet passage 26 to receive fluid from a pressurized source through the inlet line 18. Fluid from the pressurized source flows from the inlet line 18 to the retard inlet passage 26. From the retard inlet passage 26, fluid flows through the port 26*a*, annulus 26*b*, and retard check valve 32 in the outer shaft 2 to holes 4*c*, 4*a* in the inner shaft 4, to the retard passage 34 leading to the retard chamber 5 of the phaser 42, moving the vane 10*a* of the rotor 10 in the retard direction. Moving the vane 10*a* in the retard direction moves the inner shaft 4 relative to the outer shaft 2. Fluid is prevented from venting from the retard chamber 5 by second spool land 17*b*. Fluid in the advance chamber 3 exits the chamber through the advance passage 33 to the groove 4*b* on the outer surface of the inner shaft 4 and through a port 22*a* on the outer shaft 2 to an advance vent passage 22. The fluid in the advance vent passage 22 vents to sump 19. Fluid is prevented from entering the advance inlet passage 24 from groove 4*b* by advance check valve 30.

Figure 3:
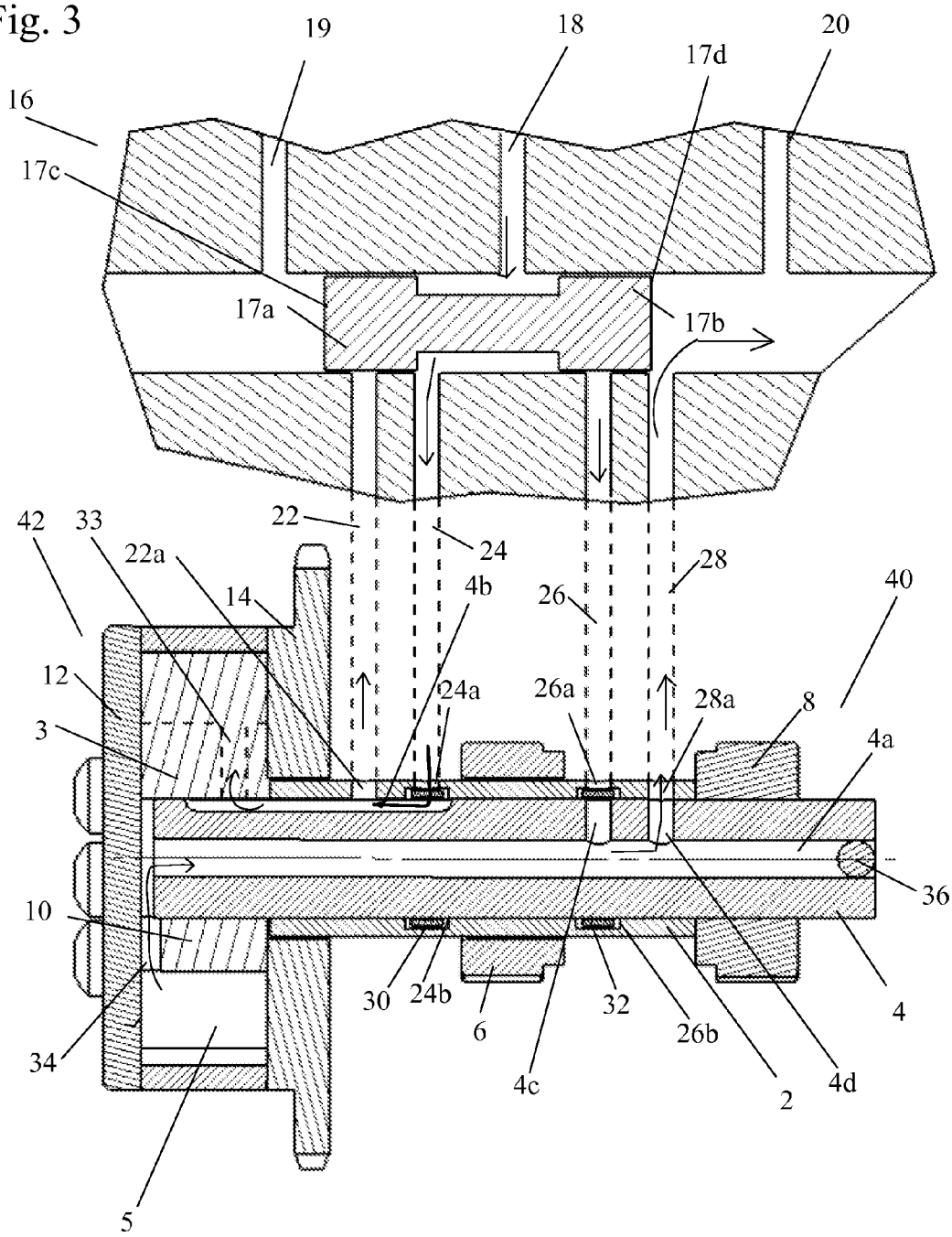
FIG. 3 shows a schematic of a camshaft assembly of a first embodiment moving towards the advance position.

FIG. 3 shows the phaser moving towards the advance position. In this position, the force on the second side 17*d* of the spool 17 is greater than the force on the first side 17*c* of the spool 17, moving the spool 17 towards a position where the first land 17*a* blocks the advance vent passage 22 and the second land 17*b* blocks the retard inlet passage 26, allowing retard vent passage 28 to be open and the advance inlet passage 24 to receive fluid from a pressurized source through the inlet line 18. Fluid from the pressurized source flows from the inlet line 18 to the advance inlet passage 24. From the advance inlet passage 24, fluid flows through the port 24*a*, annulus 24*b* and advance check valve 30 in the outer shaft 2 to groove 4*b* on the inner shaft 4, to advance passage 33 leading to the advance chamber 3 of the phaser and moving the vane 10*a* of the rotor 10 in the advance direction. Moving the vane 10*a* in the advance direction moves the inner shaft 4 relative to the outer shaft 2. Fluid is prevented from venting from the advance chamber 3 by the first spool land 17*a*. Fluid in the retard chamber 5 exits the chamber through the retard passage 34 to holes 4*a*, 4*d* in the inner shaft 4 to a retard vent passage 28. The fluid in the retard vent passage 28 vents to sump 20. Fluid is prevented from entering the retard inlet passage 26 from hole 4*c* by retard check valve 32.

Figure 4:
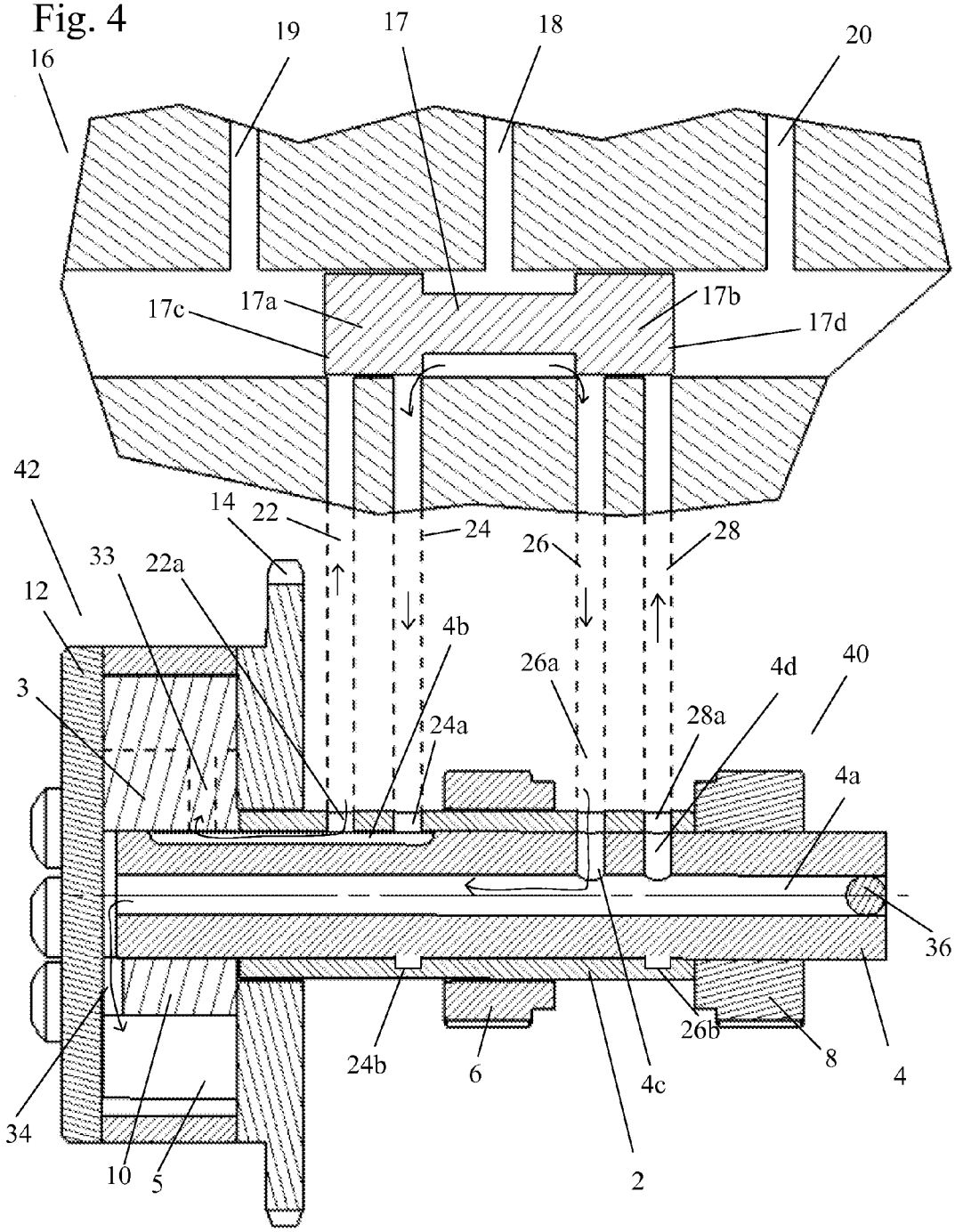
FIG. 4 shows a schematic of a camshaft assembly of a second embodiment in the null position.
Figure 5:
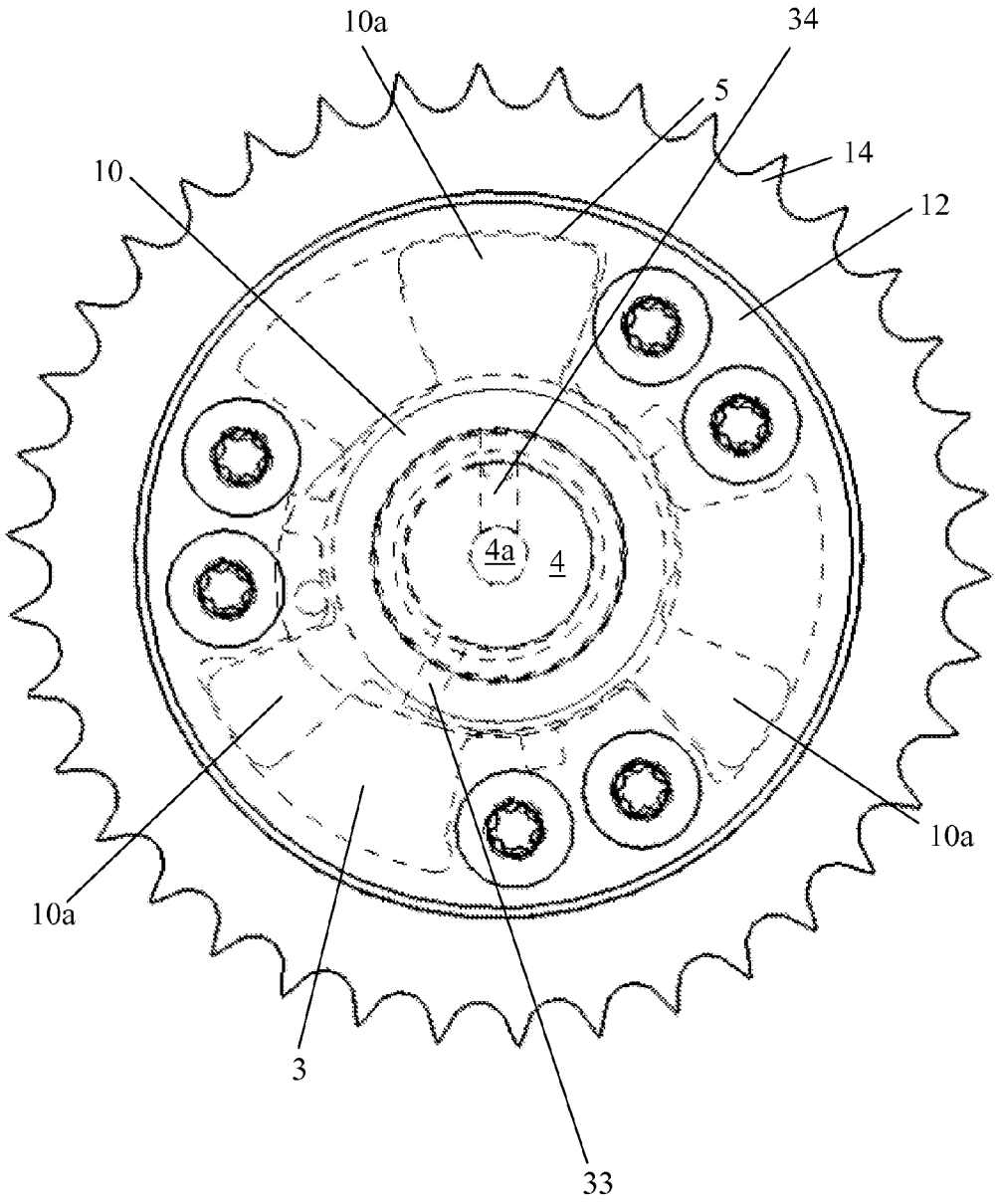
FIG. 5 shows a front view of the phaser along line A-A in FIG. 1.

FIG. 4 shows a camshaft assembly 40 of a second embodiment. As in the first embodiment, the camshaft assembly has an inner shaft 4 and an outer shaft 2. The camshaft assembly 40 may be for a multiple cylinder engine or a single cylinder engine.

For a multiple cylinder engine, the outer shaft 2 is hollow with multiple slots (not shown) that run perpendicular to the axis of rotation and has a sprocket 14 attached to the outside of the outer shaft 2. Inside the hollow outer shaft 2 is a hollow inner shaft 4 with multiple holes (not shown) that run perpendicular to the length of the shaft. A first set of cam lobes 6 are rigidly attached to the outer shaft 2 and a second set of cam lobes 8 are free to rotate and placed on the outer shaft 2 with a clearance fit. The second set of cam lobes 8 are positioned over slots (not shown) on the outer shaft 2 and are controlled by the inner shaft 4 through a mechanical connection (not shown).

For single cylinder engines, the outer shaft 2 is hollow and has a sprocket 14 attached to the outside of the outer shaft 2. Inside the hollow outer shaft 2 is a hollow inner shaft 4. At least one cam lobe 6 is directly attached or hard pressed to the outer shaft 2 and at least one other cam lobe 8 is directly attached or hard pressed to the inner shaft 4.

In the phaser 42 of this embodiment, the check valves 30, 32 have been removed from the advance inlet passage 24 and the retard inlet passage 26. The phaser of this embodiment is oil pressure actuated. The phaser 32 functions as described above, except that fluid is not physically blocked from flowing back into the advanced inlet passage 24 and the retard inlet passage 26 by a check valve. In other words, some back flow of fluid into the retard inlet passage 26 may occur and fluid may enter the advance inlet line 24 when the phaser moves to a retard position and/or during cam torque reversals. Additionally, some back flow of fluid into the advance inlet passage 24 may occur and fluid may enter the retard inlet line 26 when the phaser moves to an advance position and/or during cam torque reversals.

Figure 6:
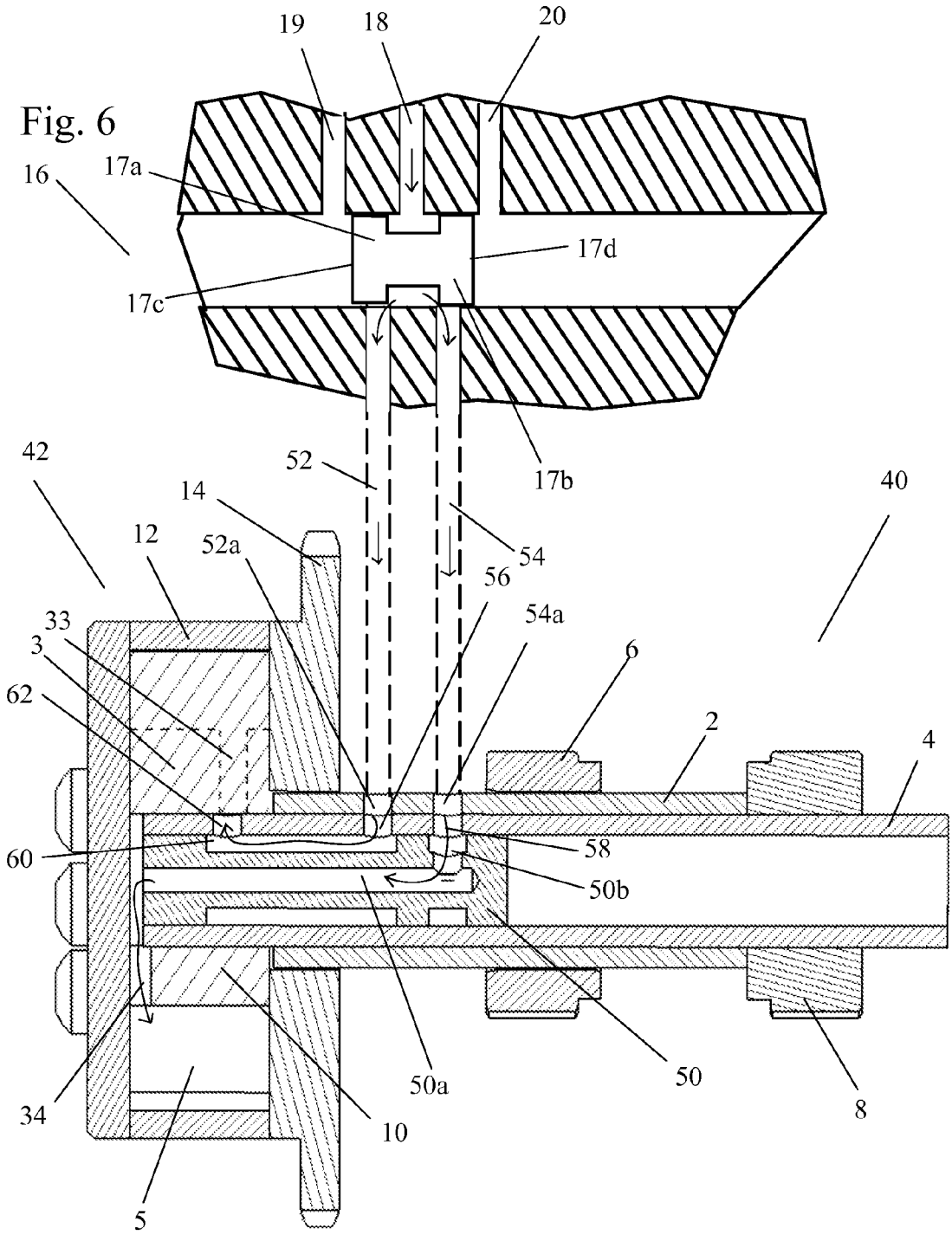
FIG. 6 shows a schematic of a camshaft assembly of a third embodiment in the null position.
Figure 7:
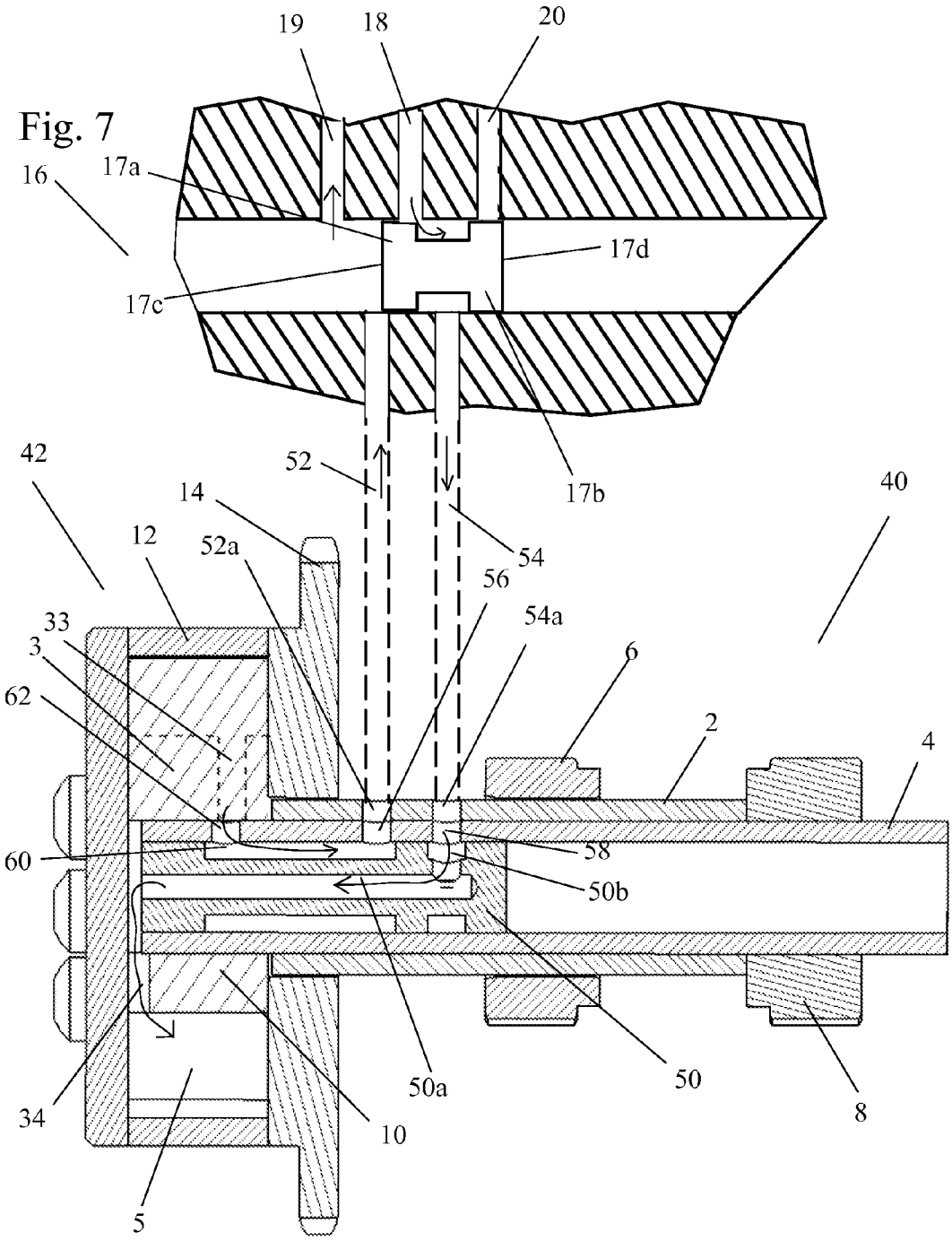
FIG. 7 shows a schematic of a camshaft assembly of a third embodiment moving towards the retard position.
Figure 8:
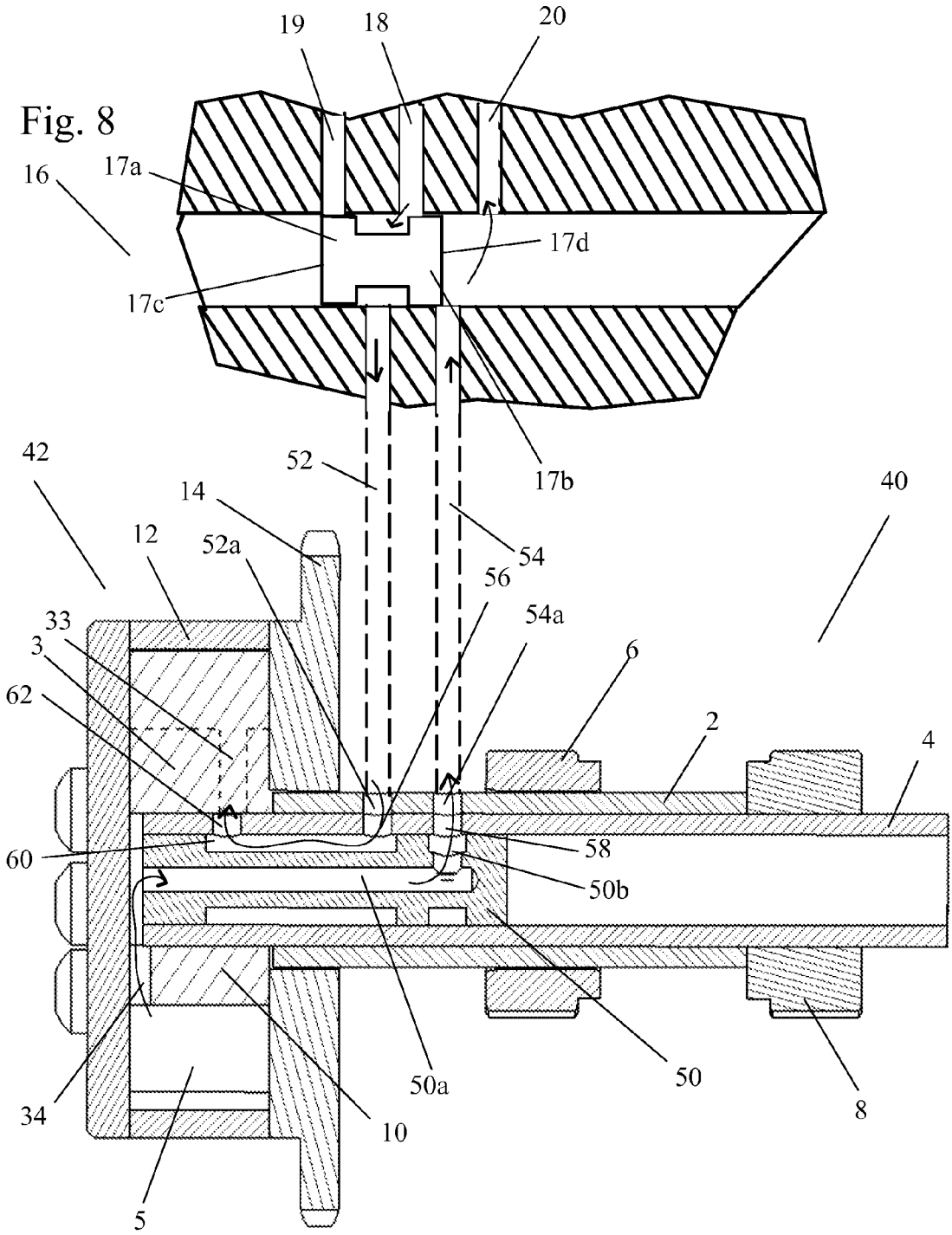
FIG. 8 shows a schematic of a camshaft assembly of a third embodiment moving towards the advance position.

FIGS. 6-8 shows a camshaft assembly of a third embodiment. Instead of having the inner shaft 4 keyed with groove 4*b*, to facilitate fluid flow between the phaser 42 and remote valve 17, a separate oil transfer sleeve 50 may be used. The oil transfer sleeve 50 is pressed into the inner shaft 4 and placed in alignment with the passages 33, 34 leading to and from the advance and retard chambers 3, 5 of the phaser, as well as with the passages 52 and 54 leading to and from the remote control valve.

The camshaft assembly 40 of the third embodiment has an inner shaft 4 and an outer shaft 2. The camshaft assembly may be for a multiple cylinder engine or a single cylinder engine.

For a multiple cylinder engine, the outer shaft 2 is hollow with multiple slots (not shown) that run perpendicular to the axis of rotation and has a sprocket 14 attached to the outside of the outer shaft 2. Inside the hollow outer shaft 2 is a hollow inner shaft 4 with multiple holes (not shown) that run perpendicular to the length of the shaft. A first set of cam lobes 6 are rigidly attached to the outer shaft 2 and a second set of cam lobes 8 are free to rotate and placed on the outer shaft 2 with a clearance fit. The second set of cam lobes 8 are positioned over slots (not shown) on the outer shaft 2 and are controlled by the inner shaft 4 through a mechanical connection (not shown).

For single cylinder engines, the outer shaft 2 is hollow and has a sprocket 14 attached to the outside of the outer shaft 2. Inside the hollow outer shaft 2 is a hollow inner shaft 4. At least one cam lobe 6 is directly attached or hard pressed to the outer shaft 2 and at least one other cam lobe 8 is directly attached or hard pressed to the inner shaft 4.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers 42 have a rotor 10 with one or more vanes 10*a* (refer to FIG. 5), mounted to the end of the camshaft assembly 40, surrounded by or coaxially located within the housing 12. The housing 12 and the rotor 10 form chambers in which the vanes 10*a* fit, dividing the chambers into advance chambers 3 and retard chambers 5. The vane 10*a* is capable of rotation to shift the relative angular position of the housing 12 and the rotor 10. It is possible to have the vanes mounted to the housing 12, and the chambers in the rotor 10, as well. A portion of the housing's outer circumference forms the sprocket 14, pulley or gear accepting drive force through a chain, belt, or gears, usually from the crankshaft, or possible from another camshaft in a multiple-cam engine and is mounted to the outer shaft 2. The inner shaft 4 is mounted to the rotor 10.

The phaser 42 adjusts the phase of the shafts 2, 4 relative to each other. A remote control valve 16 controls the flow of fluid into the camshaft assembly 40 and to the phaser 42. The remote valve 16 includes a spool 17 with at least two circumferential lands 17*a*, 17*b* biased in a first direction and a second, opposite direction. While not shown, the spool 17 may be biased by fluid, springs, or actuator or combination of fluid, springs, and actuator in first and second directions.

Passages 52, 54 between the remote control valve 16 and the camshaft assembly 40 allow fluid to be supplied to and vented from the chambers 3, 5 of the phaser. The passages 52, 54 between the remote control valve 16 and the camshaft assembly 40 lead to ports 52*a*, 54*a* in the outer shaft 2 that open to holes 56, 58 passing through the outer diameter of the inner shaft 4 to the separate oil transfer sleeve 50. From the oil transfer sleeve 50, the fluid flows to or from the advance passage 33 or the retard passage 34 to the advance or retard chambers 3, 5.

FIG. 6 shows the phaser 42 in the null position. In this position, the force on one end 17*c* of the spool 17 is equal to the force on the second end 17*d* of the spool 17. In order to provide fluid from the pressurized source (not shown) through the inlet line 18 to the advance and retard chambers 3, 5, the spool 17 may be dithered or a portion of the first and second lands 17*a*, 17*b* may be shaped to allow a small amount of fluid into the advance inlet and retard inlet passages 52 54. Fluid is supplied to the advance and retard chambers 3, 5 through passages 52, 54, and the oil transfer sleeve 50 respectively.

FIG. 7 shows the phaser moving towards the retard position. In this position, the force on the first side 17*c* of the spool 17 is greater than the force on the second side 17*d* of the spool 17, moving the spool 17 towards a position where the second land 17*b* blocks the retard vent passage 20 to sump and the first land 17*a* blocks fluid from the inlet passage 18 from flowing to the advance inlet passage 52.

Fluid from the pressurized source flows from the inlet line 18 to the retard inlet passage 54. From the retard inlet passage 54, fluid flows through the port 54*a* in the outer shaft 2, to hole 58 in the inner shaft 4 and into port 50*b* of the oil transfer sleeve 50 within the inner shaft 4. Port 50*b* of the oil transfer sleeve 50 is in fluid communication with through hole 50*a* of the oil transfer sleeve, which is in fluid communication with retard passage 34 leading to the retard chamber 5. The fluid in the retard chamber 5 moves the vane 10*a* of the rotor 10 in the retard direction. Moving the vane 10*a* in the retard direction moves the inner shaft 4 relative to the outer shaft 2.

Fluid in the advance chamber 3 exits the chamber through the advance passage 33 to the groove 60 on the outer surface of the oil transfer sleeve 50. From the groove 60 on the oil transfer sleeve 50, the fluid flows through hole 56 on the inner shaft 4 through annulus 52*a* on the outer shaft 2 and to advance inlet line 52. From the advance inlet line 52, fluid flows into the advance vent line 19 to sump.

FIG. 8 shows the phaser moving towards the advance position. In this position, the force on the second side 17*d* of the spool 17 is greater than the force on the first side 17*c* of the spool 17, moving the spool 17 towards a position where the first land 17*a* blocks the advance vent passage 19 to sump and the second land 17*b* blocks fluid from the inlet passage 18 from flowing to the retard inlet passage 54.

Fluid from the pressurized source flows from the inlet line 18 to the advance inlet passage 52. From the advance inlet passage 52, fluid flows through the port 52*a* in the outer shaft 2, to hole 56 in the inner shaft 4, and into groove 60 on the outer surface of the oil transfer sleeve 50 within the inner shaft 4. The groove 60 on the outer surface of the oil transfer sleeve 50 is in fluid communication with the advance passage 33 leading to the advance chamber 3 of the phaser. The fluid in the advance chamber 3 moves the vane 10*a* of the rotor 10 in the advance direction. Moving the vane 10*a* in the advance direction moves the inner shaft 4 relative to the outer shaft 2.

Fluid in the retard chamber 5 exits the chamber through the retard passage 34 to the through hole 50*a* of the oil transfer sleeve 50 and flows through the port 50*b* of the oil transfer sleeve, through the hole 58 in the inner shaft 4 and through port 54*a* in the outer shaft 2 to the retard inlet passage 54. From the retard inlet passage 54, the fluid flows to the retard vent line 20 to sump.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A camshaft assembly 40 for an internal combustion engine comprising:

a hollow outer shaft 2;

an inner shaft 4 received within the hollow outer shaft 2;

at least one cam lobe 6, 8 attached to the outer shaft 2 and at least one other cam lobe attached to the inner shaft 4;

a phaser 42 mounted to the inner and outer shafts 2, 4;

a remote control valve 16 controlling the flow fluid to and from the phaser 42, 32 through a plurality of passages 22, 24, 26, 28, 52, 54 and the inner shaft 4; and an oil transfer sleeve 50 inserted within the inner shaft 4 and aligned with the phaser and the plurality of passages 52, 54 in fluid communication with the remote valve 16.

2. The camshaft assembly of claim 1, wherein the phaser 42 further comprises:

a housing 12 comprising an outer circumference 14 for accepting drive force and mounted to the outer shaft 2; and a rotor 10 coaxially located within the housing 12, the housing 12 and the rotor 10 defining at least one vane separating a chamber in the housing into advance and retard chambers 3, 5, the vane 10*a* being capable of rotation to shift the relative angular position of the housing 12 and the rotor 10; the rotor 10 being mounted to the inner shaft 4.

3. The camshaft assembly of claim 1, wherein the inner shaft 4 further comprises a groove 4*b* on the outer surface of the inner shaft 4 and holes 4*a*, 4*c*, 4*d* in the inner shaft 4 in fluid communication with the phaser and the plurality of passages 22, 24, 26, 28.

4. The camshaft assembly of claim 1, wherein the inner shaft 4 further comprises holes 56, 58, 62 on the inner shaft in fluid communication with the phaser 42, 32 and the plurality of passages 52, 54.

5. The camshaft assembly of claim 2, wherein the oil transfer sleeve 50 comprises a through hole 50*a* in fluid communication with a port 50*b* on an outer surface of the oil transfer sleeve 50, a hole 58 in the inner shaft, an annulus 54*a* in the outer shaft 2 and the retard inlet line passage 54, and a retard passage 34 in fluid communication to the retard chamber 5; and a groove 60 on an outer surface in fluid communication with a hole 62 leading to the an advance passage 33 in fluid communication with the advance chamber 3, and hole 56 on the inner shaft in fluid communication with an annulus 52*a* in the outer shaft 2 and in fluid communication with the advance inlet line passage 52.

6. The camshaft assembly of claim 1, wherein the plurality of passages 22, 24, 26, 28, 52, 54 are comprised of an advance inlet passage 24, 52 an advance vent passage 22, a retard inlet passage 26, 54 and a retard vent passage 28.

7. The camshaft assembly of claim 6, wherein the advance inlet passage 24 and retard inlet passage 26 each have a check valve 30, 32.

8. The camshaft assembly of claim 1, wherein the at least one cam lobe is a first set of cam lobes fixed to the outer shaft (2); and the at least one other cam lobe is a second set of cam lobes defining a hole, placed on the outer shaft (2) such that the hole is aligned over the slots on the outer shaft (2) with a clearance fit; and a means for fixing the second set of cam lobes to the inner shaft (4), while simultaneously allowing the second set of cam lobes to clearance fit to the outer shaft (2).

9. The camshaft assembly of claim 1, wherein the at least one cam lobe is directly attached to the inner shaft 4 and the at least one other cam lobe is directly attached to the outer shaft 2.

* * * * *